US007911341B2

(12) United States Patent
Raji et al.

(10) Patent No.: US 7,911,341 B2
(45) Date of Patent: Mar. 22, 2011

(54) METHOD FOR DEFINING AND IMPLEMENTING ALARM/NOTIFICATION BY EXCEPTION

(75) Inventors: Reza Raji, Menlo Park, CA (US); Gerald Gutt, Tucson, AZ (US)

(73) Assignee: iControl Networks Inc., Palo Alto, CA (US)

( * ) Notice: Subject to any disclaimer, the term of this patent is extended or adjusted under 35 U.S.C. 154(b) by 257 days.

(21) Appl. No.: 12/019,554

(22) Filed: Jan. 24, 2008

(65) Prior Publication Data

US 2008/0180240 A1 Jul. 31, 2008

Related U.S. Application Data

(60) Provisional application No. 60/886,435, filed on Jan. 24, 2007.

(51) Int. Cl.
*G08B 13/08* (2006.01)

(52) U.S. Cl. ..... 340/545.6; 340/540; 340/539.14

(58) Field of Classification Search ..... 340/540, 340/545.6–545.9, 573.1, 539.14, 539.15, 340/541

See application file for complete search history.

(56) References Cited

U.S. PATENT DOCUMENTS

| | | | |
|---|---|---|---|
| 5,519,878 | A | 5/1996 | Dolin, Jr. |
| D416,910 | S | 11/1999 | Vasquez |
| 5,991,795 | A | 11/1999 | Howard et al. |
| 6,198,475 | B1 | 3/2001 | Humpleman |
| 6,219,677 | B1 | 4/2001 | Howard |
| 6,286,038 | B1 | 9/2001 | Reichmeyer et al. |
| 6,288,716 | B1 | 9/2001 | Humpleman et al. |
| D451,529 | S | 12/2001 | Vasquez |
| 6,331,122 | B1 | 12/2001 | Wu |
| 6,363,417 | B1 | 3/2002 | Howard et al. |
| 6,370,436 | B1 | 4/2002 | Howard et al. |
| 6,377,861 | B1 | 4/2002 | York |
| 6,400,265 | B1 | 6/2002 | Saylor et al. |

(Continued)

FOREIGN PATENT DOCUMENTS

| | | | |
|---|---|---|---|
| JP | 2003-85258 | A | 9/2001 |

(Continued)

OTHER PUBLICATIONS

Alarm.com—Interactive Security Systems, Product Advantages, printed from website Nov. 4, 2003, 3 pp.

(Continued)

*Primary Examiner* — George A Bugg
*Assistant Examiner* — Hongmin Fan
(74) *Attorney, Agent, or Firm* — Wilson Sonsini Goodrich & Rosati

(57) ABSTRACT

Methods, systems, gateways, and servers are provided for by-exception notification to a user when an event does not occur at a premises. An interface is provided through which a user can define a time window and an event capable of being sensed by a device at the premises. A server records the first event and the first time window and communicates these to a gateway at the premises. A gateway sets up an automation to detect the first event during the first time window. Devices detect if the first event occurs during the first time window. If the first event does not occur during the time window, the gateway indicates to the server the non-occurrence of the first event. The server sends notification to the user of the by-exception event. Methods, systems, gateways, and servers combine event notification upon the occurrence of an event with by-exception event notification.

38 Claims, 3 Drawing Sheets

Alarm by exception case.

U.S. PATENT DOCUMENTS

| | | | | |
|---|---|---|---|---|
| D464,328 | S | 10/2002 | Vasquez et al. | |
| D464,948 | S | 10/2002 | Vasquez et al. | |
| 6,462,663 | B1 * | 10/2002 | Wilson et al. | 340/573.1 |
| 6,467,084 | B1 | 10/2002 | Howard et al. | |
| 6,493,020 | B1 | 12/2002 | Stevenson et al. | |
| 6,496,927 | B1 | 12/2002 | McGrane et al. | |
| 6,529,723 | B1 | 3/2003 | Bentley | |
| 6,542,075 | B2 | 4/2003 | Barker et al. | |
| 6,563,800 | B1 | 5/2003 | Salo et al. | |
| 6,574,234 | B1 | 6/2003 | Myer et al. | |
| 6,580,950 | B1 | 6/2003 | Johnson et al. | |
| 6,587,736 | B2 | 7/2003 | Howard et al. | |
| 6,591,094 | B1 | 7/2003 | Bentley | |
| 6,601,086 | B1 | 7/2003 | Howard et al. | |
| 6,609,127 | B1 | 8/2003 | Lee et al. | |
| 6,615,088 | B1 | 9/2003 | Myer et al. | |
| 6,643,669 | B1 | 11/2003 | Novak et al. | |
| 6,648,682 | B1 | 11/2003 | Wu | |
| 6,661,340 | B1 | 12/2003 | Saylor et al. | |
| 6,721,689 | B2 | 4/2004 | Markle et al. | |
| 6,965,313 | B1 | 11/2005 | Saylor et al. | |
| 7,015,806 | B2 | 3/2006 | Naidoo et al. | |
| 7,034,681 | B2 | 4/2006 | Yamamoto et al. | |
| 7,113,090 | B1 | 9/2006 | Saylor et al. | |
| 7,148,810 | B2 | 12/2006 | Bhat | |
| 7,349,761 | B1 | 3/2008 | Cruse | |
| 7,430,614 | B2 | 9/2008 | Shen et al. | |
| 7,440,434 | B2 | 10/2008 | Chaskar et al. | |
| 7,469,294 | B1 | 12/2008 | Luo et al. | |
| 7,526,762 | B1 | 4/2009 | Astala et al. | |
| 7,634,519 | B2 | 12/2009 | Creamer et al. | |
| 2002/0083342 | A1 | 6/2002 | Webb et al. | |
| 2002/0095490 | A1 | 7/2002 | Barker et al. | |
| 2002/0103927 | A1 | 8/2002 | Parent | |
| 2002/0107910 | A1 | 8/2002 | Zhao | |
| 2002/0111698 | A1 | 8/2002 | Graziano et al. | |
| 2002/0118107 | A1 * | 8/2002 | Yamamoto et al. | 340/541 |
| 2002/0143923 | A1 | 10/2002 | Alexander | |
| 2002/0180579 | A1 | 12/2002 | Nagoka et al. | |
| 2002/0184301 | A1 | 12/2002 | Parent | |
| 2003/0051009 | A1 | 3/2003 | Shah et al. | |
| 2003/0062997 | A1 | 4/2003 | Naidoo et al. | |
| 2003/0115345 | A1 | 6/2003 | Chien et al. | |
| 2003/0132018 | A1 | 7/2003 | Okita et al. | |
| 2003/0174648 | A1 | 9/2003 | Wang et al. | |
| 2003/0187920 | A1 | 10/2003 | Redkar | |
| 2003/0210126 | A1 | 11/2003 | Kanazawa | |
| 2003/0236841 | A1 | 12/2003 | Epshteyn | |
| 2004/0003241 | A1 | 1/2004 | Sengodan et al. | |
| 2004/0015572 | A1 | 1/2004 | Kang | |
| 2005/0038326 | A1 * | 2/2005 | Mathur | 600/300 |
| 2005/0079855 | A1 | 4/2005 | Jethi et al. | |
| 2005/0169288 | A1 | 8/2005 | Kamiwada et al. | |
| 2005/0197847 | A1 | 9/2005 | Smith | |
| 2005/0216302 | A1 | 9/2005 | Raji et al. | |
| 2005/0216580 | A1 | 9/2005 | Raji et al. | |
| 2006/0181406 | A1 | 8/2006 | Petite et al. | |
| 2007/0052675 | A1 | 3/2007 | Chang | |
| 2007/0106124 | A1 * | 5/2007 | Kuriyama et al. | 600/300 |
| 2007/0286210 | A1 | 12/2007 | Gutt et al. | |
| 2007/0286369 | A1 | 12/2007 | Gutt et al. | |
| 2008/0147834 | A1 | 6/2008 | Quinn et al. | |
| 2008/0183842 | A1 | 7/2008 | Raji et al. | |
| 2008/0235326 | A1 | 9/2008 | Parsi et al. | |
| 2009/0204693 | A1 | 8/2009 | Andreev et al. | |
| 2009/0240787 | A1 | 9/2009 | Denny | |
| 2010/0082744 | A1 | 4/2010 | Gutt | |
| 2010/0095111 | A1 | 4/2010 | Gutt | |
| 2010/0095369 | A1 | 4/2010 | Gutt | |

FOREIGN PATENT DOCUMENTS

| | | |
|---|---|---|
| JP | 2003-141659 | 10/2001 |
| JP | 2004-192659 | 2/2004 |
| KR | 2006-0021605 | 9/2004 |
| WO | WO-01-52478 | 7/2001 |
| WO | WO-01-99078 | 12/2001 |
| WO | WO-2004-004222 | 1/2004 |
| WO | WO-2004-107710 | 12/2004 |
| WO | WO 2005/091218 A2 | 9/2005 |
| WO | WO 2005/091218 A3 | 9/2005 |

OTHER PUBLICATIONS

Alarm.com—Interactive Security Systems, Frequently Asked Questions, printed from website Nov. 4, 2003, 3 pp.

Alarm.com—Interactive Security Systems, Elders, printed from website Nov. 4, 2003, 1 page.

Alarm.com—Interactive Security Systems, Overview, printed from website Nov. 4, 2003, 2 pp.

X10—ActiveHome, Home Automation Made Easy!, printed from website Nov. 4, 2003, 3 pp.

Examination Report under Section 18(3) re UK patent application No. GB0724760.4 dated Jan. 30, 2008.

Examination Report under Section 18(3) re UK patent application No. GB0724248.0 dated Jan. 30, 2008.

Examination Report under Section 18(3) re UK patent application No. GB0724248.0 dated Jun. 4, 2008.

Examination Report under Section 18(3) re UK patent application No. GB0800040.8 dated Jan. 30, 2008.

Examination Report under Section 18(3), dated Aug. 13, 2007 re UK patent application No. GB0620362.4.

U.S. Appl. No. 12/630,092 Office Action mailed Jul. 21, 2010.

U.S. Appl. No. 12/019,568 Office Action mailed Jul. 13, 2010.

* cited by examiner

* Time window 7:30am to 3pm
* Start watching for motion at 7:30am
* Report alarm if motion is detected
* Stop watching at 3pm Normal alarm on event case.

* Time window 3pm TO 4pm
* Start watching for door open at 3pm
* Take note when door is opened
* Report alarm at 4pm if door was not opened between 3pm and 4pm Alarm by exception case.

* Start watching for motion at 7:30am
* Report alarm if motion is detected before 3pm
* Start watching for door open at 3pm
* Take note if/when door is opened
* Report alarm at 4pm if door was not opened between 3pm and 4pm Combined standard and by-exception alarm case.

System Architecture

METHOD FOR DEFINING AND IMPLEMENTING ALARM/NOTIFICATION BY EXCEPTION

CROSS-REFERENCE

This application claims the benefit of U.S. Provisional Application No. 60/886,435, filed Jan. 24, 2007, which application is incorporated herein by reference.

INCORPORATION BY REFERENCE

All publications, patents, and patent applications mentioned in this specification are herein incorporated by reference to the same extent as if each individual publication, patent, or patent application was specifically and individually indicated to be incorporated by reference. The present application incorporates by reference U.S. Provisional Application No. 60/886,435, filed Jan. 24, 2007, U.S. patent application Ser. No. 11/084,232, filed on Mar. 16, 2005 and U.S. patent application Ser. No. 11/084,657 filed on Mar. 16, 2005, in their entirety.

DETAILED DESCRIPTION OF THE INVENTION

Many systems perform alarm functions that notify us either 1) at a particular pre-determined time (e.g. an alarm clock) or 2) when some specified event "happens" (as when a burglar alarm triggers when a door is opened). An embodiment includes a way for an alarm to be triggered (usually followed by a notification of some sort) when a specified event does not happen.

Consider the case where a parent wants to have the peace of mind that a child has returned home from school (many similar scenarios exist). Using some notification paradigms one could program an alarm to trigger when the home's front door is opened. If you knew that your child should be home from school by 4 pm, you would expect a notification sometime before 4 pm that the door was opened (presumably by your child).

There are certain tradeoffs to this approach. The first is that the notification gets sent out every day, and probably whenever the door is opened any time. That may lead to a lot of additional notifications, possibly at a financial cost to the user. A "flurry" of such notifications can lead to "notification fatigue" causing the user to begin to routinely ignore or disable the service.

The second issue with this approach is that it involves active participation on the part of the user. The case that we are really concerned about is when our child does not arrive home on time. Given the notification paradigm above, that means that we need to make sure to notice if we do not get the notification by 4 PM. If the parent doesn't actively watch the time, they can miss the fact that their child is not at home on time, the very case that they do want to know about!

In the case described, what we really want is to be notified at 4 PM if and only if our child is not home. We call this notification by exception.

An embodiment achieves the notification by exception by combining the capabilities of a "schedule" with a sensor-based approach. It consists of defining a time window and an event. The time window is defined in terms of time-of-day. The system watches for a specified event within that time period. At the end of the time period, a notification is sent out if the event was not triggered in the window.

Figure 1:
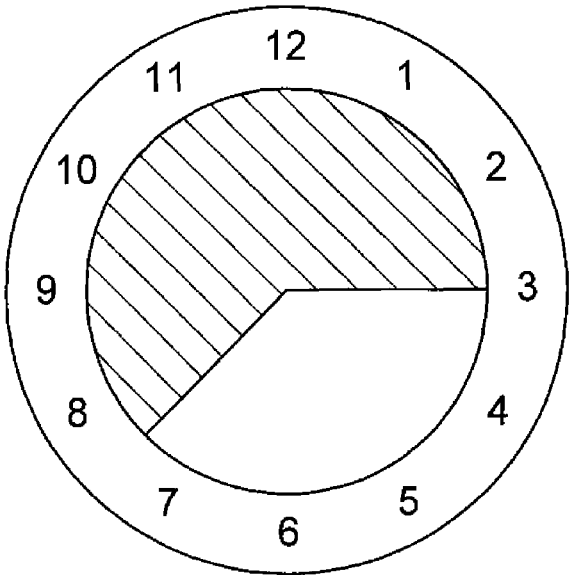
FIG. 1 depicts an event alarm according to an embodiment.

FIG. 1 shows how an alarm may be handled. In this case, a motion sensor is used inside the house. If the system is sophisticated enough, a time window (in this case from 7:30 AM to 3 PM) can be specified. Once the system is "armed" at 7:30 AM, any motion detected inside the house triggers a notification. This is the typical burglar alarm scenario.

In addition to providing burglar-alarm-type features, this system also verifies for you that, for example, your child has left for school. But it suffers from the conventional alarm problem described above—you cannot be notified that your child did not return from school at the end of the day.

Figure 2:
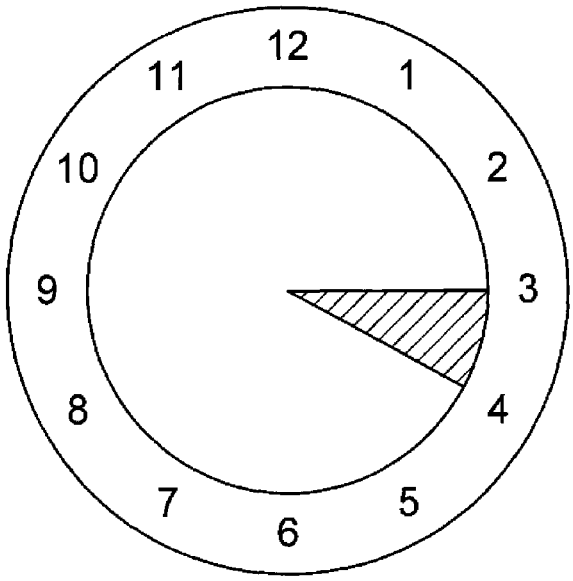
FIG. 2 depicts a by-exception alarm according to an embodiment.

FIG. 2 illustrates the alarm-by-exception method. This time, a time window may be used, as we must decide at what time we expect our watched event—the door opening when our child arrives home. In an example, we know the child should be home between 3 pm and 4 pm. The time window is set up, and the door sensor is selected as the trigger. Now the system will notify you at 4 pm if the door remained closed for that whole hour. At that point, we know there might be a problem and start to investigate.

Figure 3:
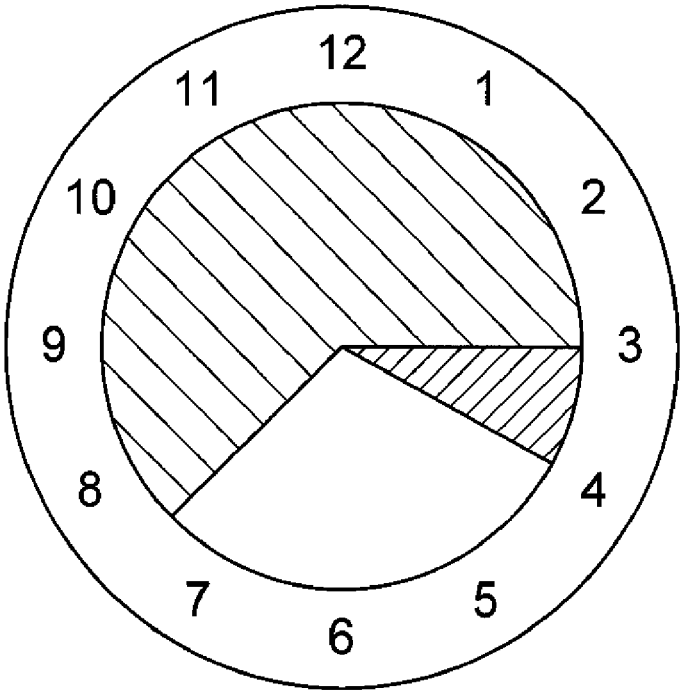
FIG. 3 depicts an event alarm and a by-exception alarm combined according to an embodiment.

FIG. 3 shows how both types of alarms can be combined. A conventional (time-window-based) alarm is set for the period between 7:30 am and 3 pm. The house should be empty during that time, so we receive a notification if, during that time window, it becomes occupied. It may be because our child did not leave for school on time, or it may be an intruder. Either way, we want to know and be notified when the motion is detected.

At 3 pm, however, we begin to expect our child to return from school. We need to disable the motion alarm, or we will get an alarm every time our child returns home. Since we want to avoid notification fatigue, we do not want that. However, now we want to know if our child does not get home by 4 pm, so we set up the notification by exception for that time window.

Implementing alarm by exception can include two underlying capabilities according to an embodiment. First, a way to specify and execute scheduled events at a particular time of day. In particular, a schedule paradigm that supports time-of-day windows is required.

A second aspect may include a way to detect and report physical events (motion detected, door opening). A variety of possible approaches to this exist—the one discussed here is to use a premises-based gateway to detect sensor activity and report that via the Internet.

Figure 4:
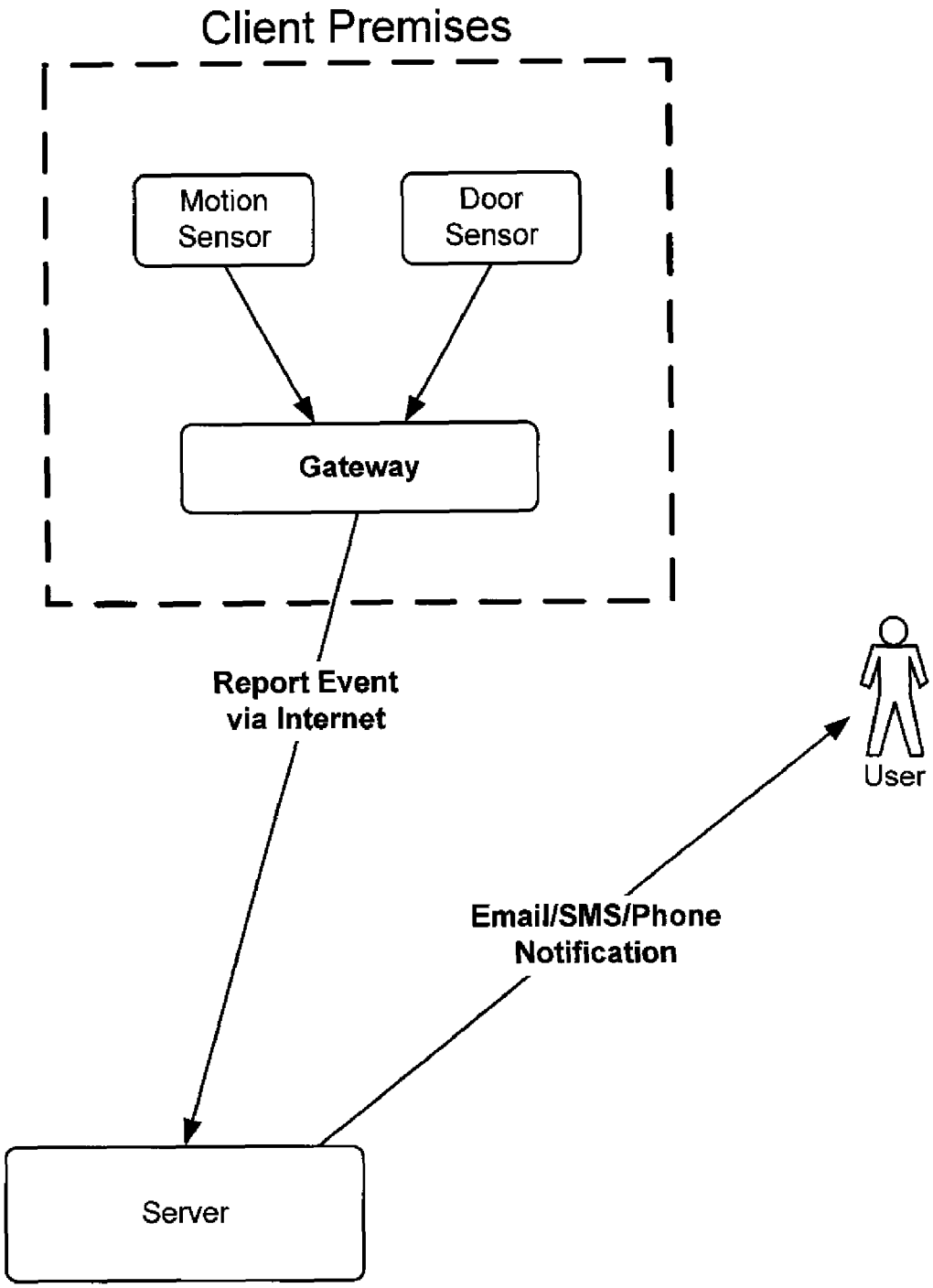
FIG. 4 is a block diagram of a method and system according to embodiments.

FIG. 4 shows a basic architecture used by an embodiment. At the user's premises, there is a gateway Internet appliance that monitors sensors on the premises. Changes in the sensor values is reported to a central server over the Internet. Users can, at any time, access the status information about their premises directly from the server (by accessing a web page), or they can receive notifications when certain events occur (and as we now see, when they do not occur).

Certain embodiments may include the following steps or various subsets or combinations thereof:

1. The user inputs (through a web page or other user interface) a time window, event to watch for, and whom to notify on a web page
2. The server creates a special schedule to send down to the gateway
3. The gateway does the following with the schedule:
1. At the start time the gateway
   1. Clears out a counter that keeps track of how many times event E has occurred
   2. Creates an automation that causes the above counter to be incremented every time event E occurs
2. During the time window
   1. Whenever event E occurs, the above counter is incremented
3. At the end of the time period
   1. The gateway checks how many times event E occurred
   2. If the count is still zero, it did not occur, so the gateway sends the by-exception event to the server. Note that various approaches other than the counter may be used to determine whether an event is sent according to various embodiments. For example, a flag may be used instead of or in addition to a counter according to various embodiments.
4. If/when the server sees the by-exception event, it creates an email, etc. and notifies the user.

The present application incorporates by reference U.S. Provisional Application No. 60/886,435, filed Jan. 24, 2007, U.S. patent application Ser. No. 11/084,232, filed on Mar. 16, 2005 and U.S. patent application Ser. No. 11/084,657 filed on Mar. 16, 2005, in their entirety.

For example, an embodiment comprises any of the above systems or methods alone or in combination as part of a network for premises management. The network may include premises management devices such as a smart thermostat. The premises management devices are connected to a premises network which can be, for example, an RF and/or power line network. The premises network is connected to a gateway which in turn is connected to a broadband device such as a DSL, cable, or T1 line. The gateway can alternatively or also be connected to a dial up modem. The premises is connected to the Internet according to an embodiment. The Internet is connected to system managers at the network operations center. The Internet, is also connected to customers of the system manager, for example vendors such as premises vendors, communication service vendors, or Internet portal vendors. The Internet is also connected to vendees, such as premises vendees, communication service vendees, or Internet portal vendees.

An embodiment may include programmable code and devices with screens of a portal interface for premises management. For example, code with may summarize premises management services. Code may summarize security management services and safety management services. Code may also summarize energy management services. Services offered by the system can be branded and incorporated into a third part web portal, for example, in a personal portal such as one provided by Yahoo.

The look and feel of the system pane can be tailored by the service provider.

In an embodiment, a system portal summary page may show a snap-shot of the state of the various devices in the user premises. For example, in an embodiment, the user can change premises by clicking on this box and selecting a different premises. A status pane may list the different devices in the user premises along with their actual states. A pending updates pane may show the time of the last communication between the premises and the server as well as any pending updates waiting to be sent downlink to the premises. The pictures pane shows the last several (e.g. last four) pictures taken by the camera in the user premises. The user can click on a thumbnail picture to look at a larger version of the photo as well as access archived images for that camera, look at live video, take new pictures or delete photos. The schedule pane shows the schedules activities for the premises. The alarm history shows an archive of the most recent event and activity in the user premises. The reminders pane provides a means for the system to remind the user to perform certain activities or functions related to their home or business. The mode drop down button on the blue navigation bar allows the user to switch between the systems modes. The QuikControl drop down allows the user to control any device that is controllable (e.g. camera, thermostat, lamps, etc.).

According for an embodiment, a method is provided for premises management networking. Premises management devices connected to a gateway at a premises are monitored and controlled. According to an embodiment, n uplink-initiation signal associated with a network operations center server is received at the premises. In response to the uplink-initiation signal, communications between the gateway and the network operations center server may be initiated from the gateway at the premises. During the communications between the gateway and the network operations center server, information associated with the premises management devices may be communicated.

The premises gateway can be a low-cost and stand-alone unit that connects the in-premises devices to the server. The connectivity to the Internet can be accomplished via a broadband connection (T1, DSL or cable) and/or via the telephone line. Though broadband connectivity may be used, telephone connectivity may be present as a back-up option in case the broadband connection is lost. For premises without a broadband connection (e.g., vacation homes) a telephone-only connection can be used.

A user account may be established by the end user using personal information (name, payment option, etc.) of the user. The account registration may involve the user logging on to the system manager web site and establishing a new account by entering name, address, phone number, payment details and/or the gateway serial number printed on the gateway in the end user's possession. In some cases the system manager service account may already be pre-established with the gateway serial number and the end user simply has to update the account with personal and payment information. Multiple gateways can also be handled per user account.

The gateway may be registered to associate the user account on the system manager server (established in the previous step) with an actual gateway in the user's home. The gateway is connected to a broadband network or the telephone line in the home.

An embodiment may help provide users with a hosted and managed service for premises device monitoring and control for a fee, such as a monthly subscription fee. The premises markets include residential homes, commercial MTUs as well as small businesses.

Embodiments may provide device logging, activity logging and tracking. For example, an embodiment can log any device variable specified by the user for up to, for example, 30 days. The user defines a logging interval for each variable at the time of configuration. The logging feature can be handled by the gateway on the local device side and the data can be transferred to the server at regular intervals. The overall variable log for all variables can be kept on the server side.

Logging of data for more than, for example, 30 days (but no more than, for example, 180 days) can be provided to the user, for example for a nominal fee. An embodiment may provide at least, for example, a 14-day history log of all user, system and device actions. An action includes a change to a device variable, system or network settings brought on by either the system or the user (e.g., variable changed, logging enabled, device added, user notified, etc.). The user can trace back system activities to their cause and to the date and time they occurred. Past activities can be searched by variable, device, category or date.

An embodiment can support user-defined modes, such as "home," "away," "sleep," "vacation," etc. The mode the user network is in plays a factor in the determination of the actions taken (reporting, alarming, eventing, notification, etc.) by the system when variable changes occur. According to an embodiment, the user can specify alarm conditions for variables with discrete states (e.g., binary ON/OFF). These alarms can be reported in real-time (i.e., immediate uplink) by the gateway to the server. The server then in turn looks at the data and determines, based on user alarm settings, whether to notify the user or not.

According to an embodiment, for non-critical events, the system can notify the user in non-real-time fashion regarding the state of any variable specified by the user. The variables chosen for user eventing can be of any kind (discrete or continuous). The gateway updates the server with the change of variable state/value at a regularly scheduled upload. The server continuously looks at variable data and determines, based on user eventing settings, whether to notify the user or not. Eventing conditions can be determined based on the value or state of a variable as well as the system mode. According to an embodiment, the system can support user alarming and eventing via the following methods: email, text messaging, pager, and/or voice telephone call (voice synthesis).

An embodiment may provide device data monitoring and control. The user can specify any device variable for monitoring and control via the server portal. For example, up to 255 devices can be supported by a single gateway. For example, up to 512 variables can be supported by a single gateway.

The system can support an open architecture where most, if not all device networking protocols can be supported. Examples of specific device protocols supported by the system include RF and powerline protocols, such as GE Interlogix RF and Echelon LonWorks power line (PL & FT), simplifying the installation burden by requiring no new wires to be installed in a premises. The LonWorks free topology twisted pair medium (FT-10) can be supported as an option to support certain commercial applications (e.g., office buildings).

The following is a non-exhaustive list of a few other devices supported by the system.

1. Small data/message display—for text messages, news, weather, stock, photos, etc.
2. Door latch control
3. Pool/spa controller
4. Weather station
5. Lighting control
6. Elderly or disabled monitoring
7. Irrigation controller (Bibija)
8. VCR programming The system can support cameras. For example, standard off-the-shelf IP cameras (also referred to as web cameras) may be used, such as those available from vendors such as Axis, Panasonic, Veo, D-Link, and Linksys, or other cameras manufactured for remote surveillance and monitoring. Surveillance cameras may contain a standalone web server and a unique IP address may be assigned to the camera. The user of such a camera would typically retrieve the camera image by accessing the camera's web page through a standard web browser, using the camera's IP address. In some cases the IP camera acquires a local IP address by using a DHCP client to negotiate an address from the local DHCP server (usually residing in the user's router/firewall).

According to an embodiment, a gateway can initiate all communications with the server. Gateway communication can either initiate based on a predetermined schedule (e.g., every 30 minutes) or due to a local premises alarm (selected by the user).

Gateways can contact a common server for their first uplink connection in order to obtain their assigned gateway server address, which they can use for all subsequent uplink connections (unless changed later by the system). In the event that the gateway cannot connect to its designated gateway server, it can fall back to contacting the default initial gateway in order to refresh its gateway server address.

The predetermined call initiation schedule can be programmable by the server and can provide different intervals for broadband and telephone intervals (e.g., every 30 minutes for broadband and every 90 minutes for telephone).

An embodiment may be directed to a control network having a collection of sensor and actuator devices that are networked together. Sensor devices sense something about their surroundings and report what they sense on the network. Examples of sensor devices are door/window sensors, motion detectors, smoke detectors and remote controls.

Actuator devices receive commands over the network and then perform some physical action. Actuator devices may include light dimmers, appliance controllers, burglar alarm sirens and cameras. Some actuator devices also act as sensors, in that after they respond to a command, the result of that command is sent back over the network. For example, a light dimmer may return the value that it was set to. A camera returns an image after has been commanded to snap a picture.

In addition to the foregoing, the following are various examples of embodiments of systems, devices and methods provided herein.

Some embodiments of a method for premises management networking include monitoring premises management devices connected to a gateway at a premises; controlling premises management devices connected to the gateway at the premises; receiving, at the premises, an uplink-initiation signal associated with a network operations center server; and in response to the uplink-initiation signal, initiating, from the gateway at the premises, communications between the gateway and the network operations center server; and communicating, during the communications between the gateway and the network operations center server, information associated with the premises management devices.

The uplink-initiation signal can be received via telephone and/or broadband connection. The gateway can initiate communications between the gateway and the network operations center server with at least an HTTP message and/or at least an XML message. The premises management devices can manage energy of the premises, security of the premises, and/or safety of the premises. Many embodiments provide a hosted solution for property developers, owners and managers as well as service providers (ISPs, telcos, utilities, etc.) such as communication service providers and Internet portal providers. Some embodiments offer a complete, turnkey, reliable, and/or cost-effective solution for the delivery of telemetry services (e.g., energy management, security, safety, access, health monitoring, messaging, etc.) to customers.

An embodiment is directed to a business method for premises management. Some embodiments of a business method for premises management include making an Internet portal available for access to a vendee, such as a premises vendee, communication service vendee, and/or an Internet portal vendee; and at least after a transaction between the vendor and the vendee, such as a premises transaction, a communication services transaction, and/or Internet portal services transaction, providing premises management services via the Internet portal to the vendee.

The Internet portal can be branded with a brand of the vendor according to an embodiment. Examples of a premises vendor include a home builder, premises builder, and premises manager. Examples of a premises vendee include a home buyer, premises buyer, and premises tenant. Examples of a communication service vendor include an Internet service provider, a telephone company, a satellite television company, and a cable television company. Examples of a communication service vendee include a customer of the Internet service provider, a customer of the telephone company, a customer of the satellite television company, and a customer of the cable television company. Premises management services can manage energy of the premises, security of the premises, and/or safety of the premises.

An embodiment is directed to a system. The system includes a network of premises management devices, a gateway coupled to the network and premises management devices, a server coupled to the gateway by a communication medium and a portal coupled to the communications medium. The portal provides communication with the premises management devices.

According to various embodiments alone or in various combinations: the communications medium may comprise the Internet; the portal may comprise an internet portal; and/or the portal may be branded with the name of a vendor of a product associated with the premises. The product may comprise a building, and/or the vendor may comprise a party that leases the premises. The vendor may also or alternatively comprise a property management organization. The server may be included within a network operations center. The logic may comprise, according to various embodiments, software, hardware, or a combination of software and hardware.

Another embodiment is directed to a gateway. The gateway includes an interface coupled to a network of premises management devices, logic that receives data from different premises management devices, and an interface coupled to a communications medium that is coupled to a server. The server is coupled to a portal coupled to the communications medium. The portal provides communications with the premises management devices.

According to various embodiments alone or in various combinations: the communications medium may comprise the Internet; the portal may comprise an internet to portal; and/or the portal may be branded with the name of a vendor of a product associated with the premises. The product may comprise a building; the vendor may comprise a party that leases the premises; the vendor may comprise a property management organization; and/or the server may be included within a network operations center.

Provided herein is a method for notifying a user that an event has not occurred on a premises. The premises has devices for monitoring and/or controlling the premises. The devices may be coupled to a gateway through a network. The gateway may be coupled to a server by the Internet. The server may be accessible to the user through the Internet. In some embodiments, the method comprises providing an interface through which a user can define a first time window and a first event capable of being sensed by a first device at the premises during the first time window, detecting whether the first event occurred at the premises during the first time window, and sending a notification if the first event does not occur during first time window.

The user, through the interface, can define a person to notify if the first event does not occur during the first time window. This may be the user or another person.

The first event may be motion at the premises, and the first device may be a motion sensor. The first event may be a door opening at the premises, and first device may be a door sensor. Other devices and events, by way of non-limiting example, such as those provided herein, are envisioned.

The interface may be provided to the user over the Internet. The first time window defined by the user and the first event defined by the user may be recorded by the server. In some embodiments of the method, the server creates a schedule based on the first event defined by the user and the first time window defined by the user to send to the gateway. In some embodiments, status information on the sever about the premises may be accessed by the user.

In some embodiments of the method, the gateway clears a counter that keeps track of how many times the first event has occurred. The gateway may create an automation based, for example, on the schedule from the server, and/or from the first event and the first time window, that causes the counter to be incremented every time the first event occurs. The method may further comprise gateway incrementing the counter whenever the first event occurs during the first time window. In some embodiments, at the end of the first time window, the gateway checks the counter to determine how many times the first event occurred. The gateway may then send to the server a first by-exception event if the counter is zero, wherein the first by-exception event is the non-occurrence of the first event.

In some embodiments of the method, the gateway clears a flag that keeps track of whether the first event has occurred. The gateway may create an automation that causes the flag to be indicated if the first event occurs. At the end of the first time window, the gateway may check the flag to determine if the first event occurred. If the flag is not indicated, the gateway may send to the server a first by-exception event, wherein the first by-exception event is the non-occurrence of the first event.

Some embodiments of the method comprise the server creating at least one of an email, a short message service (SMS), and a phone notification to at least one of the user and a person indicated by the user to notify.

A method may further comprise combining the by-exception event alarm with a standard alarm if an event does occur. In such a method, any of the by-exception methods described herein may further comprise providing an interface through which a user can define a second time window, providing an interface through which a user can define a second event capable of being sensed by a second device at a premises, detecting whether the second event occurred at the premises within the second time window, and sending a notification if second event occurs during second time window. In such a method, the first event and the second event may be the same event or different events. The first device and the second device may be the same device or different devices. The first time window and the second window may or may not overlap.

Provided herein is a system for notifying a user that an event has not occurred on a premises. The premises has devices for monitoring and/or controlling the premises. The devices may be coupled to a gateway through a network. The gateway may be coupled to a server by the Internet. The server mat be accessible to the user through the Internet. The system comprises: a first device at the premises coupled to the gateway; an interface through which the user can define a first time window and a first event capable of being sensed by the first device at the premises during the first time window; the gateway comprising an automation that detects whether the first event occurs at the premises during the first time window; and a notification if the first event does not occur during first time window.

Through the interface, the user can define a person to whom the notification is sent if the first event does not occur during the first time window. The interface may be provided to the user over the Internet. Status information on the sever about the premises may be accessed by the user.

The first event may be motion at the premises wherein the first device is a motion sensor. In some embodiments, the first event is a door opening at the premises wherein the first device is a door sensor. Other devices and events, by way of non-limiting example, such as those provided herein, are envisioned.

The server may comprise a schedule based on the first event defined by the user and the first time window defined by the user to send to the gateway.

In some embodiments of the system, the gateway comprises a counter that keeps track of how many times the first event has occurred. The gateway may comprise logic that clears the counter at the start of and/or before the first time window. The automation may comprises logic that increments the counter whenever the first event occurs during the first time window. The gateway may comprises logic that, at the end of and/or after the first time window, checks the counter to determine how many times the first event occurred. The gateway may comprise logic that, if the counter is zero, sends to the server a first by-exception event, wherein the first by-exception event is the non-occurrence of the first event.

In some embodiments of the system, the gateway comprises logic that clears a flag that keeps track of whether the first event has occurred. The automation may indicate the flag if the first event occurs. The gateway may comprise logic that, at the end of the first time window, checks whether the flag is indicated to determine if the first event occurred. The gateway may comprise logic that, if the flag is not indicated, sends to the server a first by-exception event, wherein the first by-exception event is the non-occurrence of the first event.

The server may comprise logic that creates the notification, wherein the notification comprises at least one of an email, a short message service (SMS), and a phone notification.

The system may combine the by-exception event alarm with a standard alarm if an event does occur. In such a system, any of the by-exception notification systems provided herein may further comprise: a second device at the premises coupled to the gateway, an interface through which a user can define a second time window and a second event capable of being sensed by the second device at the premises during the second time window. The gateway may comprise an automation that detects whether the second event occurs at the premises during the second time window. The system may further comprise a notification if the second event occurs during second time window. The interface may be the same interface as was provided for the by-exception event system and/or method for by-exception alarming. The first event and the second event may be the same event or a different event. The first device and the second device may be the same device or different devices. The first time window and the second window may or may not overlap.

In some embodiments of the system, the logic comprises hardware. In some embodiments, the logic comprises software.

Provided herein is a gateway coupled to a network of devices on a premises and coupled to a server by the Internet for notifying a user that an event has not occurred on a premises, wherein the server is accessible to the user through the Internet, wherein the gateway comprises: an automation that detects whether a first event occurs at the premises during a first time window; and logic that sends to the server a first by-exception event if the first event does not occur, wherein the first by-exception event is a non-occurrence of the first event.

The first event may be defined by the user and the first time window may be defined by the user. The first event may be motion at the premises and the first device may be a motion sensor. The first event may be a door opening at the premises and the first device may be a door sensor. Other devices and events, by way of non-limiting example, such as those provided herein, are envisioned.

The gateway may comprises logic that receives a schedule from the server based on the first event defined by the user and the first time window defined by the user to send to the gateway.

The gateway may comprise a counter that keeps track of how many times the first event has occurred. The gateway may comprise logic that clears the counter at the start of and/or before the first time window. The automation may comprise logic that increments the counter whenever the first event occurs during the first time window. The gateway comprises logic that, at the end of and/or after the first time window, checks the counter to determine how many times the first event occurred. The gateway may comprise logic that, if the counter is zero, sends to the server the first by-exception event.

The gateway may comprise logic; that clears a flag that keeps track of whether the first event has occurred. The automation may indicates the flag if the first event occurs. The gateway may comprise logic that, at the end of the first time window, checks whether the flag is indicated to determine if the first event occurred. The gateway may comprise logic that, if the flag is not indicated, sends to the server the first by-exception event.

The gateway may be configured to combine the by-exception event alarm with a standard alarm if an event does occur. In such a system a second device may be coupled to the gateway by the network. The gateway may further comprises an automation that detects whether a second event occurs at the premises during a second time window, wherein the second event and the second time window are defined by the user. The first event and the second event may be the same event or different events. The first device and the second device may be the same device or different devices. The first time window and the second window may or may not overlap.

In some embodiments of the gateway, the logic comprises hardware. In some embodiments, the logic comprises software.

Provided herein is a server for notifying a user that an event has not occurred on a premises. Devices for monitoring and/or controlling the premises are at the premises. The server is coupled to a gateway by the Internet and the gateway is coupled to the devices on the premises. In some embodiments, the server comprises logic that allows a user access to a user account for the premises, wherein the account is on the server, and wherein the user accesses the user account through the Internet. The server may comprise logic that receives a first time window and a first event from the user, wherein the first event is capable of being sensed by a first device at the premises during the first time window. The server may comprise logic that creates a notification if the first event does not occur during first time window. The server may comprise logic that sends the notification to at least one of the user and a person designated by the user to receive the notification.

The first event may be defined by the user and the first time window may be defined by the user. The first event may be motion at the premises and the first device may be a motion sensor. The first event may be a door opening at the premises and the first device may be a door sensor. Other devices and events, by way of non-limiting example, such as those provided herein, are envisioned.

In some embodiments, the server comprises a schedule based on the first event defined by the user and the first time window defined by the user to send to the gateway. The server may comprise logic that sends the schedule to the gateway. The server may comprise status information about the premises that may be accessed by the user.

The server may further comprise logic that receives from the gateway a first by-exception event, wherein the first by-exception event is the non-occurrence of the first event. Notification sent by the server to the user or a person designated by the user may comprise at least one of an email, a short message service (SMS), and a phone notification.

The server may be configured to combine the by-exception event alarm with a standard alarm if an event does occur. In such a system a second device may be coupled to the gateway by the network. The server may also comprise logic that receives a second time window and a second event from the user, wherein the second event is capable of being sensed by a second device at the premises during the second window. The server may also comprise logic that creates a notification if the second event occurs during first time window. In some embodiments, the server comprises logic that sends the notification to at least one of the user and a person designated by the user to receive the notification. The first event and the second event may be the same event or different events. The first device and the second device may be the same device or different devices. The first time window and the second window may or may not overlap.

In some embodiments of the server, the logic comprises hardware. In some embodiments, the logic comprises software.

As used herein, using the phrase "first device" does not necessarily mean there is a second device (although in some embodiments there may any number of additional devices, or none at all, i.e. a second device, a third device, a fourth device, etc.). If there is a second device (third, fourth, etc.), however, it does not mean the first device comes before the second device in time (although it may), importance (although it may), order (although it may), or in any other way (although it may), unless stated. The term "first" is merely used for clarity. As is noted elsewhere herein, the first device may be the same device as the second device, or it may not be. Likewise, it is merely for clarity that "first, second" etc. is used herein to describe the time window and/or the event. Using the phrase "first event" does not necessarily mean there is a second event (although in some embodiments there may be any number of additional events, i.e. a second event, a third event, a fourth event, etc.). Using the phrase "first time window" does not necessarily mean there is a second time window (although in some embodiments there may be any number of additional time windows, i.e. a second time window, a third time window, a fourth time window, etc.). Use of the term "first" with respect to an event or a time window does not necessarily meant that the "first" time window and/or event comes before the second in time (although it may), importance (although it may), order (although it may), or in any other way (although it may), unless stated. For non-limiting example, the first time window may occur after or before the second time window. For non-limiting example, the first time window may be concurrent with and/or overlap the second time window. The first time window may be the same time window as the second time window. For non-limiting example, the first event may occur after, before, and/or concurrently with the second event. The first event may be the same event as the second event. The same may be said for additional events, time windows, and/or devices (third, fourth, filth, etc.).

Aspects of the systems and methods described herein may be implemented as functionality programmed into any of a variety of circuitry, including programmable logic devices (PLDs), such as field programmable gate arrays (FPGAs), programmable array logic (PAL) devices, electrically programmable logic and memory devices and standard cell-based devices, as well as application specific integrated circuits (ASICs). Some other possibilities for implementing aspects of the systems and methods include: microcontrollers with memory, embedded microprocessors, firmware, software, etc. Furthermore, aspects of the systems and methods may be embodied in microprocessors having software-based circuit emulation, discrete logic (sequential and combinatorial), custom devices, fuzzy (neural network) logic, quantum devices, and hybrids of any of the above device types. Of course the underlying device technologies may be provided in a variety of component types, e.g., metal-oxide semiconductor field-effect transistor (MOSFET) technologies like complementary metal-oxide semiconductor (CMOS), bipolar technologies like emitter-coupled logic (ECL), polymer technologies (e.g., silicon-conjugated polymer and metal-conjugated polymer-metal structures), mixed analog and digital, etc.

It should be noted that the various functions or processes disclosed herein may be described as data and/or instructions embodied in various computer-readable media, in terms of their behavioral, register transfer, logic component, transistor, layout geometries, and/or other characteristics. Computer-readable media in which such formatted data and/or instructions may be embodied include, but are not limited to, non-volatile storage media in various forms (e.g., optical, magnetic or semiconductor storage media) and carrier waves that may be used to transfer such formatted data and/or instructions through wireless, optical, or wired signaling media or any combination thereof. Examples of transfers of such formatted data and/or instructions by carrier waves include, but are not limited to, transfers (uploads, downloads, email, etc.) over the Internet and/or other computer networks via one or more data transfer protocols (e.g., HTTP, FTP, SMTP, etc.). When received within a computer system via one or more computer-readable media, such data and/or instruction-based expressions of components and/or processes under the systems and methods may be processed by a processing entity (e.g., one or more processors) within the computer system in conjunction with execution of one or more other computer programs.

Unless the context clearly requires otherwise, throughout the description and the claims, the words 'comprise,' 'comprising,' and the like are to be construed in an inclusive sense as opposed to an exclusive or exhaustive sense; that is to say, in a sense of 'including, but not limited to.' Words using the singular or plural number also include the plural or singular number respectively. Additionally, the words 'herein,' 'here-under,' 'above,' 'below,' and words of similar import refer to this application as a whole and not to any particular portions of this application. When the word 'or' is used in reference to a list of two or more items, that word covers all of the following interpretations of the word: any of the items in the list, all of the items in the list and any combination of the items in the list.

The above description of illustrated embodiments of the systems and methods is not intended to be exhaustive or to limit the systems and methods to the precise form disclosed. While specific embodiments of, and examples for, the systems and methods are described herein for illustrative purposes, various equivalent modifications are possible within the scope of the systems and methods, as those skilled in the relevant art will recognize. The teachings of the systems and methods provided herein can be applied to other processing systems and methods, not only for the systems and methods described above.

The elements and acts of the various embodiments described above can be combined to provide further embodiments. These and other changes can be made to the systems and methods in light of the above detailed description.

In general, the terms used should not be construed to limit the systems and methods to the specific embodiments disclosed in the specification and the claims, but should be construed to include all processing systems that operate under the claims. Accordingly, the systems and methods are not limited by the disclosure.

While certain aspects of the systems and methods may be presented in certain claim forms, the inventors contemplate the various aspects of the systems and methods in any number of claim forms. Accordingly, the inventors reserve the right to add additional claims after filing the application to pursue such additional claim forms for other aspects of the systems and methods.

What is claimed is:

1. A method for notifying a user that an event has not occurred on a premises comprising:

providing an interface through which a user can define a first time window and a first event capable of being sensed by a first device at a premises during the first time window wherein devices for monitoring and/or controlling the premises are at the premises, wherein the devices are coupled to a gateway through a network and the gateway is coupled to a server by the Internet, and wherein the server is accessible by the user through the Internet;

detecting whether the first event occurred at the premises during the first time window; and sending a notification if the first event does not occur during first time window, wherein the first time window has a start time that is defined by the user in terms of a time-of-day and an end time that is defined by the user in terms of a time-of-day.

2. The method of claim 1, wherein through the interface, the user can define a person to notify if the first event does not occur during the first time window.

3. The method of claim 1, wherein the first event is motion at the premises wherein the first device is a motion sensor.

4. The method of claim 1, comprising the server recording the first event and the first time window defined by the user.

5. The method of claim 1, comprising if the first event does not occur during first time window the gateway sending to the server a first by-exception event, wherein the first by-exception event is the non-occurrence of the first event.

6. The method of claim 1, wherein the sending the notification comprises the server creating at least one of an email, a short message service (SMS), and a phone notification to at least one of the user and a person indicated by the user.

7. The method of claim 1 further comprising:

providing an interface through which a user can define a second time window;

providing an interface through which a user can define a second event capable of being sensed by a second device at a premises;

detecting whether the second event occurs at the premises within the second time window; and sending a notification if second event occurs during second time window, wherein the first event and the second event are at least one of the same event and a different event, wherein the first device and the second device are at least one of the same device and different devices, and wherein the first time window and the second window do not overlap.

8. A system for notifying a user that an event has not occurred on a premises comprising:

a first device at the premises coupled to a gateway, wherein devices are located at the premises for monitoring and/or controlling the premises, wherein the devices are coupled to the gateway though a network and the gateway is coupled to a server by the Internet, and wherein the server is accessible by the user through the Internet;

an interface through which the user can define a first time window and a first event capable of being sensed by the first device at the premises during the first time window;

the gateway comprising an automation that detects whether the first event occurs at the premises during the first time window; and a notification if the first event does not occur during first time window, wherein the first time window has a start time that is defined by the user in terms of a time-of-day and an end time that is defined by the user in terms of a time-of-day.

9. The system of claim 8, wherein the first event is motion at the premises wherein the first device is a motion sensor.

10. The system of claim 8, wherein the server comprises a schedule based on the first event defined by the user and the first time window defined by the user.

11. A system for notifying a user that an event has not occurred on a premises comprising:

a first device at the premises coupled to a gateway, wherein devices are located at the premises for monitoring and/or controlling the premises, wherein the devices are coupled to the gateway though a network and the gateway is coupled to a server by the Internet, and wherein the server is accessible by the user through the Internet; and an interface through which the user can define a first time window and a first event capable of being sensed by the first device at the premises during the first time window, the gateway comprising:

an automation that detects whether the first event occurs at the premises during the first time window, a notification if the first event does not occur during first time window, a counter that keeps track of how many times the first event has occurred, logic that clears the counter at the start of and/or before the first time window, and logic that, at the end of and/or after the first time window, checks the counter to determine how many times the first event occurred, wherein the automation comprises logic that increments the counter whenever the first event occurs during the first time window.

12. The system of claim 11, wherein the gateway comprises logic that, if the counter is zero, sends to the server a first by-exception event, wherein the first by-exception event is the non-occurrence of the first event.

13. The system of claim 11, wherein the logic comprises hardware.

14. The system of claim 11, wherein the logic comprises software.

15. The system of claim 8, wherein the server comprises logic that creates the notification, wherein the notification comprises at least one of an email, a short message service (SMS), and a phone notification.

16. The system of claim 8, wherein the gateway comprises:

logic that clears a flag that keeps track of whether the first event has occurred; and logic that, at the end of the first time window, checks whether the flag is indicated to determine if the first event occurred, wherein the automation indicates the flag if the first event occurs.

17. The system of claim 16, wherein the gateway comprises logic that, if the flag is not indicated, sends to the server a first by-exception event, wherein the first by-exception event is the non-occurrence of the first event.

18. The system of claim 17, wherein the server comprises logic that creates the notification, wherein the notification comprises at least one of an email, a short message service (SMS), and a phone notification.

19. The system of claim 16, wherein the logic comprises hardware.

20. The system of claim 16, wherein the logic comprises software.

21. The system of claim 8, comprising:

a second device at the premises coupled to the gateway;

an interface through which a user can define a second time window and a second event capable of being sensed by the second device at the premises during the second time window;

the gateway comprising an automation that detects whether the second event occurs at the premises during the second time window; and a notification if the second event occurs during second time window.

22. A gateway for notification by exception when an event has not occurred on a premises, the gateway comprising:

an automation that detects whether a first event occurs at the premises during a first time window, wherein the gateway is coupled to devices for monitoring and/or controlling a premises through a network, wherein the gateway is coupled to a server by the Internet for notifying a user that an event has not occurred on a premises, and wherein the server is accessible to the user through the Internet; and logic that sends to the server a first by-exception event if the first event does not occur, wherein the first by-exception event is a non-occurrence of the first event, wherein the first time window has a start time that is defined by the user in terms of a time-of-day and an end time that is defined by the user in terms of a time-of-day.

23. The gateway of claim 22, wherein the first event is defined by the user and the first time window is defined by the user.

24. The gateway of claim 22, wherein the first event is motion at the premises wherein the first device is a motion sensor.

25. The gateway of claim 22, wherein the gateway comprises logic that receives a schedule from the server based on the first event defined by the user and the first time window defined by the user to send to the gateway.

26. The gateway of claim 22, wherein the gateway comprises:

a counter that keeps track of how many times the first event has occurred; and logic that clears the counter at the start of and/or before the first time window, wherein the automation comprises:

logic that increments the counter whenever the first event occurs during the first time window, and wherein the gateway further comprises logic that, at the end of and/or after the first time window, checks the counter to determine how many times the first event occurred, and logic that, if the counter is zero, sends to the server the first by-exception event.

27. The gateway of claim 26, wherein the gateway comprises logic that clears a flag that keeps track of whether the first event has occurred, wherein the automation indicates the flag if the first event occurs, and wherein the gateway comprises:

logic that, at the end of the first time window, checks whether the flag is indicated to determine if the first event occurred, and logic that, if the flag is not indicated, sends to the server the first by-exception event.

28. The gateway of claim 22, wherein a second device is coupled to the gateway through the network, wherein the gateway further comprises an automation that detects whether a second event occurs at the premises during a second time window, wherein the second event and the second time window are defined by the user, wherein the first event and the second event are at least one of the same event and a different event, wherein the first device and the second device are at least one of the same device and different devices, and wherein the first time window and the second time window do not overlap.

29. The gateway of claim 22, wherein the logic comprises hardware.

30. The gateway of claim 22, wherein the logic comprises software.

31. A server for notifying a user that an event has not occurred on a premises, wherein the server comprises:

logic that allows a user access to a user account for the premises, wherein the account is on the server, and wherein the user accesses the user account through the Internet;

logic that receives a first time window and a first event from the user, wherein the first event is capable of being sensed by a first device at the premises during the first time window, wherein devices for monitoring and/or controlling the premises are at the premises, wherein a server is coupled to a gateway by the Internet and the gateway is coupled to the devices on the premises;

logic that creates a notification if the first event does not occur during first time window; and logic that sends the notification to at least one of the user and a person designated by the user to receive the notification, wherein the first time window has a start time that is defined by the user in terms of a time-of-day and an end time that is defined by the user in terms of a time-of-day.

32. The server of claim 31, further comprising:

a schedule based on the first event defined by the user and the first time window defined by the user to send to the gateway; and logic that sends the schedule to the gateway.

33. The server of claim 31, comprising status information about the premises that may be accessed by the user.

34. The server of claim 31, comprising logic that receives from the gateway a first by-exception event, wherein the first by-exception event is the non-occurrence of the first event.

35. The server of claim 31, wherein the notification comprises at least one of an email, a short message service (SMS), and a phone notification.

36. The server of claim 31, comprising:

logic that receives a second time window and a second event from the user, wherein the second event is capable of being sensed by a second device at the premises during the second window;

logic that creates a notification if the second event occurs during first time window; and logic that sends the notification to at least one of the user and a person designated by the user to receive the notification, wherein the first event and the second event are at least one of the same event and different events, wherein the first device and the second device are at least one of the same device and different devices, and wherein the first time window and the second window do not overlap.

37. The server of claim 31, wherein the logic comprises hardware.

38. The server of claim 31, wherein the logic comprises software.

* * * * *